United States Patent [19]

Renoux

[11] 4,008,824

[45] Feb. 22, 1977

[54] CONTAINER CLOSURE HAVING TEAR-AWAY CONSTRUCTION

[76] Inventor: Charles Simon Renoux, 14 Rue d'Orchampt, Paris 18eme, France

[22] Filed: Apr. 2, 1975

[21] Appl. No.: 564,491

[30] Foreign Application Priority Data

Apr. 9, 1974 United Kingdom ..... 15693/74

[52] U.S. Cl. ..... 220/270; 220/269; 222/541

[51] Int. Cl.² ..... B65D 41/32

[58] Field of Search ..... 220/265, 268, 266, 269, 220/270; 222/541; 229/7 R

[56] References Cited

UNITED STATES PATENTS

| | | | |
|---|---|---|---|
| 3,307,746 | 3/1967 | Edwards | 220/265 X |
| 3,362,569 | 1/1968 | Geiger | 220/268 |

*Primary Examiner*—George T. Hall

[57] ABSTRACT

A closure member for the end of a soft drink container, beer container or the like comprises a pair of substantially parallel, upstanding ridges which are adapted to be squeezed toward one another to tear an opening in the container closure along a line of weakness.

8 Claims, 11 Drawing Figures

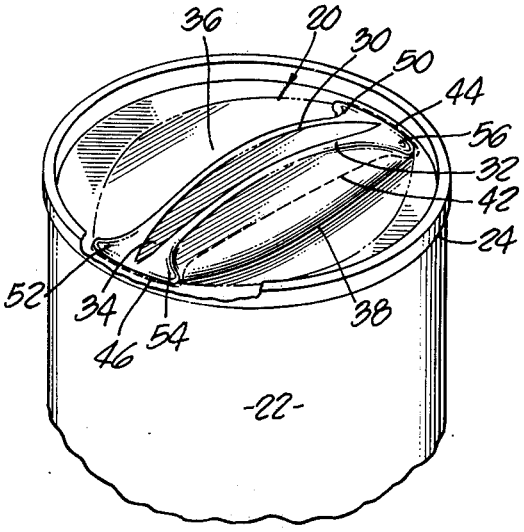
FIG. 1.
FIG. 2.
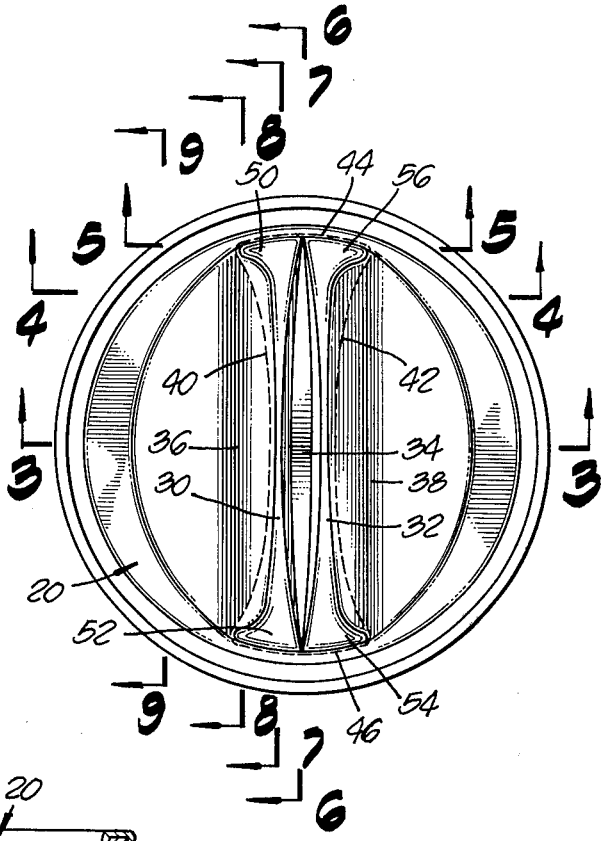
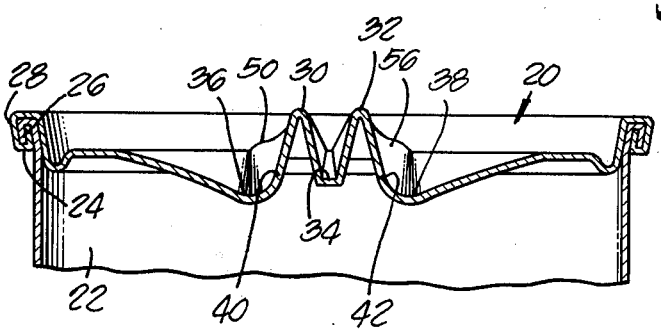
FIG. 3.
FIG. 4.
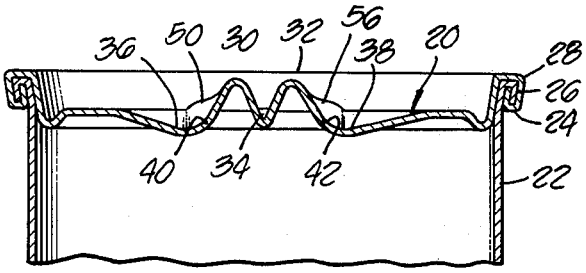
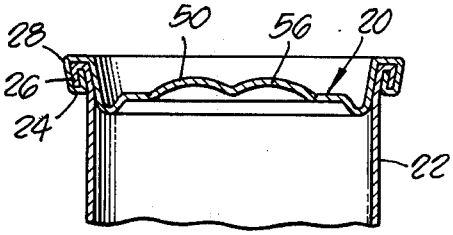
FIG. 5.

CONTAINER CLOSURE HAVING TEAR-AWAY CONSTRUCTION

SUMMARY OF THE INVENTION

The present invention relates to closures for containers and, more specifically, to the so-called "tear-tab" or "pull-open" closures commonly used for soft drink, beer and other liquid containers.

The so-called "tear-open" or "pull-tab" container closures for soft drink cans, beer cans and the like have met with wide-spread usage and substantial commercial success. Typically, such container closures are provided with a pre-cut line of weakness, sometimes called a "score line," encircling a portion of the closure, and a ring member which is riveted to a portion of the closure which is encircled by the line of weakness. The ring member is adapted to receive a person's finger to permit the person to pull the ring and tear the tab (i.e., the portion of the container closure which is enclosed by the line of weakness) from the closure to create an opening for emptying the contents of the can.

While, as noted above, these "tear-open" or "pull-tab" type containers have met with substantial acceptance and commercial success, the process for manufacturing such container closures is not inexpensive and requires several separate steps. After the closure is stamped out of a metal sheet and the score line or line of weakness is cut therein, it is necessary to separately form the ring member and thereafter to rivet the ring member to the "tab" portion of the closure.

Not only is the foregoing, multi-step process somewhat expensive, but, in addition, the resulting end product is not always as effective as is desired. A consumer or user of the contents of the container may, in attempting to open the closure, pull the ring off of its rivet without tearing the tab to form the necessary opening.

Still further, relatively sharp corners formed by the riveting of the ring to the tab may partially destroy or provide imperfections in the protective coating which is normally applied to the underside of the closure (i.e., to the surface of the closure which faces and contacts the contents of the container).

In view of the foregoing, it is an object of the present invention to eliminate the foregoing shortcomings of existing "tear-open" or "pull-tab" container closures and to provide, in their stead, a container closure which may be manufactured in a single-step stamping or pressing operation and which is more effective and reliable than the prior art container closures.

The foregoing and other objects and advantages of the present invention have been realized by providing a container closure having a score line or line of weakness cut therein, and an upstanding ridge which may be grasped and pulled by the consumer or user to tear an opening in the closure along the line of weakness.

Other objects, features and advantages of the present invention will become apparent from the following description and the attached drawings of a preferred embodiment.

BRIEF DESCRIPTION OF THE DRAWINGS

In the drawings:

FIG. 1 is a perspective view of the top portion of a can having secured thereon a cover or closure which is constructed in accordance with the teachings of the present invention.

FIG. 2 is a top plan view of the closure member of the present invention.

FIGS. 3, 4, 5, 6, 7, 8, and 9 are sectional elevation views taken along the planes 3—3, 4—4, 5—5, 6—6, 7—7, 8—8 and 9—9, respectively, of FIG. 2 and looking in the direction of the arrows.

DESCRIPTION OF A PREFERRED EMBODIMENT

Figure 6:
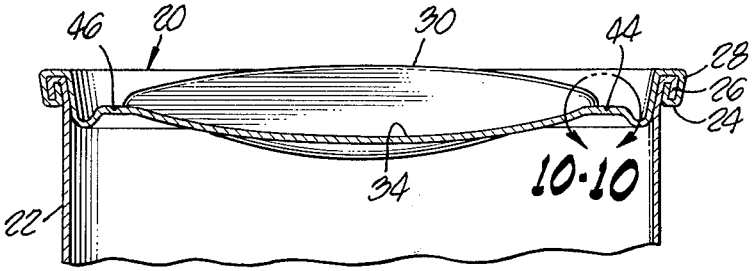

Referring to the drawings, FIG. 1 shows a preferred embodiment of a container closure or cover 20 constructed in accordance with the present invention and secured over the open top of a container 22. As best shown in FIGS. 3–9, the outer peripheral edge 24 of the cover member 20 is rolled or curled together with the upper peripheral edge 26 of the container 22 to form a peripheral seam 28. Preferably, the curled outer peripheral edges 24, 26 of the cover member 20 and the upper end of container 22 are hermetically sealed (e.g., as by welding) in a manner which is conventional, per se.

The closure 20 is stamped between two mating dies (not shown) to provide the configuration shown in the drawings. The closure member includes a pair of substantially parallel, upstanding ridges 30, 32 which extend substantially diametrically across the cover or closure member 20. A generally diametrically extending space or valley 34 is defined by the upstanding ridges 30, 32 and lies therebetween.

A depression 36 is formed in the container cover 20 adjacent the outer surface of the upstanding ridge 30 and a depression 38 is formed adjacent the outer surface of the upstanding ridge 32. These depressions, 36 and 38, are provided to accommodate the thumb and forefinger of a user to facilitate opening of the container.

As best shown in FIG. 1 and by a comparison of FIGS. 2, 3, 4, and 5, each of the upstanding ridges 30 and 32 is generally arc-shaped having its high point in the center of the cover member 20 and tapering to low points adjacent the peripheral edge of the cover member.

Figure 10:
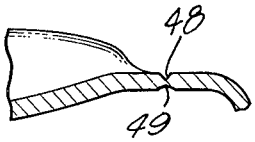
FIG. 10 is an enlarged sectional elevation view of the portion of the preferred embodiment of the closure of the present invention which is encircled by the arc 10—10 of FIG. 6.
Figure 7:
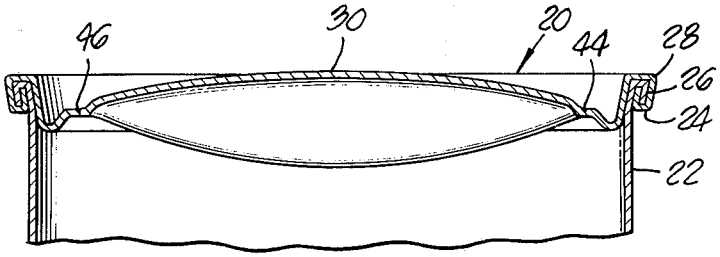
Figure 8:
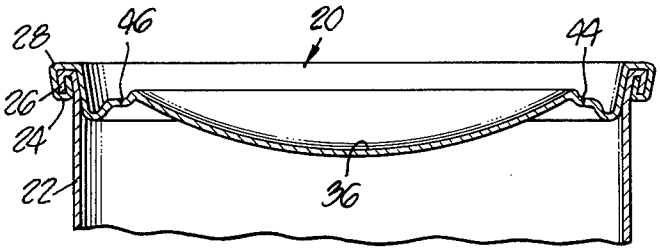
Figure 9:
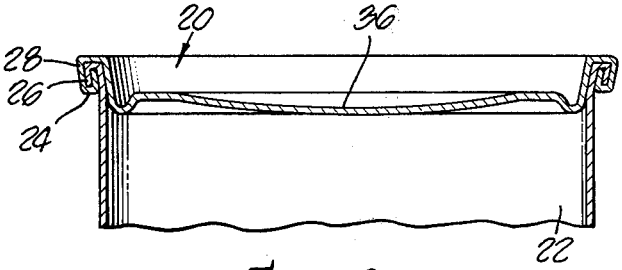

As best shown in FIGS. 2, 3, 6 and 10, score lines or lines of weakness 40 and 42 are provided in the cover member adjacent the lower, outer portion of upstanding ridges 30 and 32, respectively. These score lines 40 and 42 terminate adjacent the outer peripheral edge of the cover member 20 and are connected to one another at their ends by means of score lines 44 and 46. The score lines 40, 42, 44 and 46 define a continuous line of weakness encircling the upstanding ridges 30 and 32 to facilitate tearing off of the portion of the cover member 20 enclosed thereby. As best shown in FIG. 10, the score lines may be in the form of a cut or notch 42 which extends partially through the thickness of the closure member 20.

Figure 11:
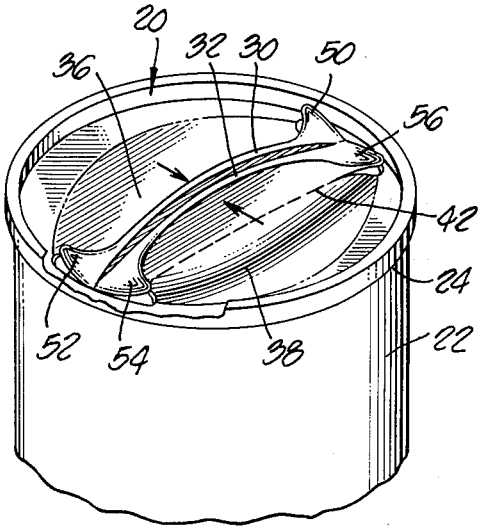
FIG. 11 is a perspective view similar to FIG. 1 but showing a preferred embodiment of the cover member of the present invention as it would appear when one is in the process of opening it.

When it is desired to open the cover member 20 of the container 22 the ridges 30 and 32 are grasped between the thumb and forefinger on the outside surfaces of the ridges and squeezed together. When so squeezed one or more of the four outer corners 50, 52, 54, 56 of the portion encircled by the score lines will tear away from the remainder of the cover member, as shown in FIG. 11. The portion of the cover member 20 encircled by the score lines can then be torn from the remainder of the cover member by simply pulling the upstanding ridges upwardly to create an opening which will be defined by the score lines.

It may be desirable to provide some sort of roughened surface (not shown) on the outer surfaces of the upstanding ridges 30 and 32 to facilitate gripping, squeezing and pulling the same.

Of course, it is contemplated that numerous modifications may be made to the structure of the preferred embodiment shown in the drawings described above without departing from the spirit and scope of the present invention. By way of example (not by way of limitation), it is contemplated that only a single upstanding ridge 30 or 32 may be provided instead of two ridges.

By way of further example, it is contemplated that each ridge 30 and/or 32 may extend less than the full diameter of the cover member. In this regard, it is contemplated that each ridge 30 and/or 32 may extend from the outer peripheral portion of the cover member, radially inwardly toward the center of the cover member, and terminate at, short of or beyond the center of the cover member.

Still further, it is contemplated that the score lines may enclose only a portion of the cover member (as shown in the preferred embodiment of the drawings) or it may enclose substantially the entire surface of the cover member, for removing solid or semi-solid materials from the container, for example.

It will be appreciated that the closure member 20 described above and shown in the drawings is easier and less expensive to manufacture, and is more reliable in operation, than the type of closure where a ring is riveted to a portion of the area enclosed by a score line and used to tear the enclosed portion from the remainder of the closure.

Numerous other modifications of the particular embodiment shown in the drawings and described above will occur to those in the art to which the present invention pertains. Accordingly, it is intended that the scope of this patent be determined only by the scope of the appended claims.

I claim:

1. A closure for a container comprising: a generally circular metal member having an outer peripheral edge adapted to be secured and sealed around the peripheral opening of a generally cylindrical container; means defining a continuous line of weakness enclosing a portion of the upper surface of said member which extends substantially diametrically across a major portion of said closure; and a pair of substantially parallel, substantially diametrically extending upstanding ridges within said portion of said member which is enclosed by said line of weakness; said upstanding ridges being integrally formed in said member; said upstanding ridges being spaced from one another to define a generally diametrically extending space therebetween; said upstanding ridges being adapted to be squeezed towards one another to tear a portion of said member along a portion of said line of weakness and thereafter, to be pulled to tear the entire portion of said member enclosed by said line of weakness from the remainder of said member to form an opening therein through which the contents of a container to which said member is connected may be removed; and means defining a depressed area in said metal member adjacent the outwardly facing surface of each of said upstanding ridges for accommodating the thumb and forefinger of a user to facilitate squeezing said upstanding ridges toward one another.

2. A closure for a container comprising: a member having an outer peripheral edge adapted to be connected to the open end of a container; score line means defining a line of weakness in said member; and at least one upstanding ridge integrally formed in said member; means defining a depressed area in said member adjacent to said upstanding ridge to accommodate a finger of a user to facilitate tearing of said member to form an opening therein; said upstanding ridge being adapted to be grasped by a user to tear a portion of said member to form an opening in said member.

3. A closure according to claim 2 wherein there are provided a pair of substantially, parallel, upstanding ridges integrally formed in said member; said upstanding ridges being spaced from one another to define a space therebetween; said upstanding ridges being adapted to be squeezed toward one another to tear a portion of said member along said line of weakness to form an opening therein.

4. A closure according to claim 3, and further comprising means defining a depressed area adjacent each of said upstanding ridges to accommodate the thumb and forefinger of a user to facilitate squeezing of said upstanding ridges toward one another.

5. A closure according to claim 2 wherein said line of weakness is continuous and encloses a finite area of said member.

6. A closure according to claim 2, wherein there are a pair of upstanding ridges integrally formed in said member; said upstanding ridges extending substantially diametrically across said member and being spaced from one another to define a generally diametrically extending space therebetween; and wherein said line of weakness is continuous and encloses a finite portion of said member which includes said upstanding ridges; said ridges being adapted to be squeezed toward one another to tear a portion of said member along a portion of said line of weakness and, thereafter, to tear the entire finite portion enclosed by said line of weakness from the remainder of said member.

7. A closure according to claim 6 and further comprising means defining a depressed area adjacent the outer surface of each of said upstanding ridges for accommodating the thumb and forefinger of a user to facilitate squeezing of said ridges together to form an opening in said closure.

8. In combination, a container having a peripheral edge defining an opening therein, and a closure for said opening; said closure comprising a member having an outer peripheral edge secured to and hermetically sealed to said peripheral edge of said container; said member including means defining a continuous line of weakness enclosing a portion of the upper surface of said member which extends substantially diametrically across a major portion of said closure; and a pair of substantially parallel, substantially diametrically extending upstanding ridges within said portion of said member which is enclosed by said line of weakness; said upstanding ridges being integrally formed in said member; said upstanding ridges being spaced from one another to define a generally diametrically extending space therebetween; said upstanding ridges being adapted to be squeezed toward one another to tear a portion of said member along a portion of said line of weakness and thereafter, to be pulled to tear the entire portion of said member enclosed by said line of weakness from the remainder of said member to form an opening therein through which the contents of a container to which said member is connected may be removed; and means defining a depressed area in said metal member adjacent the outwardly facing surface of each of said upstanding ridges for accommodating the thumb and forefinger of a user to facilitate squeezing said upstanding ridges toward one another.

* * * * *